United States Patent [19]

Schulze-Berge

[11] 4,416,740

[45] Nov. 22, 1983

[54] METHOD AND BATH FOR THE ELECTRODEPOSITION OF PALLADIUM/NICKEL ALLOYS

[75] Inventor: Klaus Schulze-Berge, Remscheid, Fed. Rep. of Germany

[73] Assignee: Langbein-Pfanhauser Werke AG, Neuss, Fed. Rep. of Germany

[21] Appl. No.: 355,246

[22] Filed: Mar. 5, 1982

[30] Foreign Application Priority Data

Mar. 6, 1981 [DE] Fed. Rep. of Germany ..... 3108467

[51] Int. Cl.[3] ..... C25D 3/56

[52] U.S. Cl. ..... 204/43 N

[58] Field of Search ..... 204/43 N, 47, 49

[56] References Cited

U.S. PATENT DOCUMENTS

| | | | |
|---|---|---|---|
| 2,781,306 | 2/1957 | Brown | 204/49 |
| 3,002,903 | 10/1961 | Foulke et al. | 204/49 |
| 3,133,006 | 5/1964 | Ostrow | 204/49 |
| 3,186,926 | 6/1965 | Hofmann et al. | 204/49 |
| 4,077,855 | 3/1978 | Popescu | 204/49 |

FOREIGN PATENT DOCUMENTS

| | | | |
|---|---|---|---|
| 1143178 | 2/1969 | United Kingdom | 204/43 N |

*Primary Examiner*—G. L. Kaplan
*Assistant Examiner*—Nam X. Nguyen
*Attorney, Agent, or Firm*—Karl F. Ross; Herbert Dubno

[57] ABSTRACT

A method of electrodepositing a palladium/nickel alloy coating upon a substrate wherein the coating is plated onto the substrate by electrodeposition from a bath containing 5 to 30 g per liter of palladium and 5 to 30 g per liter of nickel and having a palladium-nickel ratio such that the coating contains 30 to 90% by weight of palladium. The bath is provided during the electrodeposition of the coating with at least one acetylene amine or amino alcohol capable of improving the brightness and mechanical properties of the coating.

2 Claims, No Drawings

METHOD AND BATH FOR THE ELECTRODEPOSITION OF PALLADIUM/NICKEL ALLOYS

CROSS-REFERENCE TO RELATED APPLICATIONS

This application is related to my copending applications Ser. No. 355,245 and Ser. No. 355,247 filed concurrently herewith.

FIELD OF THE INVENTION

My present invention relates to a method of electrodepositing or galvanically plating palladium/nickel alloys and, more particularly, to an improved bath for such galvanic deposition and to a method of forming improved coatings utilizing the new bath.

BACKGROUND OF THE INVENTION

It is known to deposit palladium/nickel alloy coatings galvanically, i.e. by electrodeposition, upon conductive substrates for decorative or technological purposes from a bath consisting essentially of an aqueous solution of palladium and nickel amines with a palladium content of about 5 to 30 g per liter, a nickel content of about 5 to 30 g per liter, and other substances such as sulfonic acids or salts thereof, the palladium/nickel ratio in this solution being established such that the galvanically deposited coating contains 30 to 90% by weight palladium.

Coatings of this type can be used as a substitute for gold platings for decorative and some anticorrosion purposes.

A conventional bath of the aforedescribed type is disclosed in British Pat. No. 1,143,178. The sulfonic acid salts are there deemed to constitute brighteners which can be added to the bath to improve the aesthetic appearance of the coating.

The salts which are employed are certain salts of naphthalene sulfonic acid and aromatic sulfonamides such as the sodium salt of naphthalene-1,3,6-trisulfonic acid, and saccharin (o-sulfobenzioc acid imide) and para-toluenesulfonamide.

In practice, the mechanical properties of the coatings thus produced are not fully satisfactory and, indeed, the brightness may not be sufficient for many decorative purposes.

OBJECTS OF THE INVENTION

It is the principal object of the present invention to provide an improved method of the electrodepositing palladium-nickel alloy coatings whereby the disadvantages of earlier methods are obviated.

Another object of this invention is to provide an improved bath for palladium/nickel coating.

A further object of this invention is to provide a method of and a bath for the galvanic deposition of palladium/nickel coatings which have improved mechanical properties and brightness so that the use of such coatings for technological purposes as well as for decorative purposes is enlarged.

SUMMARY OF THE INVENTION

I have found, quite surprisingly, that improved mixed-crystal formation can be ensured in a palladium-nickel coating and the brightness increased while the mechanical properties of the coating are improved if there is added to the plating bath at least one and preferably a plurality of compounds selected from the group which consists of acetylene amines and acetylene amino alcohols.

The addition of such compounds to the bath which contains palladium amines and a palladium content of 5 to 30 g per liter, nickel amines and the nickel content of about 5 to 30 g per liter, and a palladium/nickel ratio so that the galvanically deposited coating contains 30 to 90% by weight palladium, has been found to vastly improve the quality of the coating.

The additive preferably consists of at least one compound and preferably a plurality of compounds having the formula $R_1—C\equiv C—R_2$ wherein $R_1$ is amino, alkylamino, dialkylamino, hydroxyalkylamino or hydroxydialkylamino and $R_2$ is hydrogen, alkyl or hydroxy alkyl.

In the foregoing definition, the term "alkyl" is intended to mean straight or branched chain alkyl having 1–6 carbon atoms.

Preferably, the additive consists of at least one compound selected from the group which consists of dimethylpropyn-2-ylamine, 1-diethylaminopropyn-(2), 1-diethylaminopentyn-2-ol-(4), 1-dimethylaminopropyn-(2) and 1,1-diethylpropyn-2-ylamine.

Mixtures of two or more of these compounds are preferable to the use of a single one of the compounds alone and the preferred amount of the additive is 0.01 to 10 grams per liter of the bath.

When these compounds are utilized in place of the sulfonic acid salts heretofore used, a number of surprising results are obtained:

The mixed crystal formation is constituted by fine and uniformly distributed crystallites.

The brightness is increased.

Ductility and corrosion resistance to a variety of corrosive influences are increased.

During the deposition the leveling effect is markably improved.

The acetylene amines can be used in conjunction with the sulfonate salts listed in Ser. No. 355,245 and/or the acetylene alcohols of Ser. No. 355,247 with advantage.

SPECIFIC DESCRIPTION AND EXAMPLES

Example 1

(Acetyleneamine Additive to Bath)

The electrolyte is constituted as follows:

20 g of palladium as $(Pd(NH_3)_4)Cl_2$
10 g of nickel as $(Ni(NH_3)_6)SO_4$
50 g of conductivity-promoting salts in the form of $(NH_4)_2SO_4$ or $NH_4Cl$
$NH_4OH$ to establishment of a pH-value of 8.5
water sufficient to bring the bath to one liter
0.03 ml of 1,1-dimethylpropyn-2-ylamine.

The bath temperature for the electrodeposition was 30° C., the substrate was moved slightly during the deposition, the cathodic current density was 1 ampere per $dm^2$ and the plating time was 10 minutes. The anode was an inert plate, e.g. stainless steel.

The substrate was a wire-brushed brass plate and the resulting coating was a bright palladium/nickel alloy layer with low leveling and without visible inhibition zones. To test the corrosion resistance of this layer, the sheet was immersed for 60 sec. in dilute nitric acid formed from equal parts of concentrated nitric acid and water. No corrosion was visible.

When the process described in British Pat. No. 1,143,178 is utilized, however, and the electrolyte instead of the aforementioned acetyleneamine contains 10 g of sodium naphthalene-1-,3,6-trisulfonate, the palladium/nickel layers show marked corrosion in the aforedescribed test, have less brightness and no leveling effect.

The difference in corrosive active appears to be a result of a poor mixed crystal formation in the method utilizing the aromatic sulfonic acid salts in place of the acetyleneamine. X-ray analysis shows the presence of free nickel in the coating and this is presumed to be the source of the greater corrodability.

Example 2

(Additive: Combination of Acetyleneamines)

The following electrolyte is produced:

20 g palladium as $(Pd(NH_3)_4)SO_4$
10 g nickel as $(Ni(NH_3)_6)Cl_2$
50 g conductivity-promoting salts such as $(NH_4)_2SO_4$ or $NH_4Cl$ to the desired conductivity
$NH_4OH$ to a pH value of 8.5
water sufficient for a one liter bath
0.03 ml 1,1-dimethypropyn-2-ylamine
0.03 ml 1-dimethylaminopropyn-(2).

During galvanic deposition the bath temperature was held at 30° C. The substrate was slightly moved during the plating. The cathodic current density was 1 ampere per $dm^2$ and the deposition time was 10 min.

The brushed brass plate serving as the substrate received a bright palladium/nickel coating with greater leveling effect than in Example 1 and without inhibition phenomena. The plating resisted the nitric acid corrosion test previously described.

Example 3

(Additive: A Combination of Acetyleneamines in Combination with Acetylene Alcohols)

The following electrolyte is formed:

20 g palladium as $(Pd(NH_3)_4)Cl_2$
10 g nickel as $(Ni(NH_3)_6)SO_4$
50 g conductivity-promoting salts such as $(NH_4)_2SO_4$ or $NH_4Cl$ to the desired conductivity
$NH_4OH$ to a pH value of 8.5
water sufficient for a one liter bath
0.03 ml 1,1-dimethylpropyn-2-ylamine
0.03 ml 1-dimethylaminopropyn-(2)
0.01 g butyne-2-diol (1,4).

The bath temperature during galvanic electrodeposition was 30° C., the substrate, brushed brass, was slightly moved during the deposition, the cathodic current density was one ampere per $dm^2$ and the plating time was 10 min.

The bright palladium/nickel coating did not show visible leveling or the formation of inhibition zones. The nitric acid test previously described in Example 1 was resisted by the product.

Example 4

(Additive: A Combination of Acetyleneamines in Combination with an Acetylene Alcohol and a Sulfonic Acid Salt)

The following electrolyte was made:

20 g palladium as $(Pd(NH_3)_4)Cl_2$
10 g nickel as $(Ni(NH_3)_6)SO_4$
50 g conductivity-promoting salts such as $(NH_4)_2SO_4$ or $NH_4Cl$ to the desired conductivity
$NH_4OH$ to a pH value of 8.5
water sufficient for a one liter bath
0.03 ml 1,1-dimethylpropyn-2-ylamine
0.03 ml 1-dimethylaminopropyn-2-
0.01 g butyne-2-diol (1,4)
2.5 g sodium allysulfonate.

The bath temperature during galvanic deposition was held at 30° C., the substrate was slightly moved during the deposition and the cathodic current density was 1 ampere per $dm^2$. The plating time was 10 min. The brushed brass plate was formed with a bright self leveled palladium/nickel coating without inhibition phenomena. It resisted the nitric acid corrosion test of Example 1.

I claim:

1. In a method of electrodepositing a palladium/nickel alloy coating upon a substrate wherein said coating is plated onto said substrate by electrodeposition from a bath containing 5 to 30 g per liter of palladium and 5 to 30 g per liter of nickel and having a palladium-nickel ratio such that the coating contains 30 to 90% by weight of palladium, the improvement which comprises providing in said bath during the electrodeposition of said coating at least one acetyleneamine or amino alcohol capable of improving the brightness and mechanical properties of said coating and selected from the group which consists of:

dimethylpropyn-2-ylamine,
1-diethylaminopropyn-(2),
1-diethylaminopentyn-2-ol-(4),
1-dimethylaminopropyn-(2), and
1,1-diethylpropyn-2-ylamine, and mixtures thereof.

2. A bath for the electrodeposition of palladium/nickel alloy coatings upon a substrate, said bath comprising an aqueous solution of a palladium amine in an amount sufficient to provide a palladium content in said bath of 5 to 30 g per liter, a nickel amine in an amount sufficient to provide a nickel content in said bath of 5 to 30 g per liter, the palladium-nickel ratio being sufficient to deposit a coating of 30 to 90 weight % palladium, and at least one acetyleneamine or acetyleneamino alcohol compound in an amount of 0.01 g per liter to 10 g per liter, sufficient to improve the brightness of said coating and selected from the group which consists of:

dimethylpropyn-2-ylamine
1-diethylaminopropyn-(2)
1-diethylaminopentyn-2-ol-(4)
1-dimethylaminopropyn-(2)
1,1-diethylpropyn-2-ylamine and mixtures thereof.

* * * * *